US010327983B2

(12) United States Patent
Schnurr

(10) Patent No.: US 10,327,983 B2
(45) Date of Patent: Jun. 25, 2019

(54) GANJA VIBE

(71) Applicant: Heather B. Enterprises, LLC, Houston, TX (US)

(72) Inventor: Heather Nicole Schnurr, Hollywood, CA (US)

(73) Assignee: HEATHER B. ENTERPRISES, LLC, Houston, TX (US)

( * ) Notice: Subject to any disclaimer, the term of this patent is extended or adjusted under 35 U.S.C. 154(b) by 0 days.

(21) Appl. No.: 14/089,739

(22) Filed: Nov. 25, 2013

(65) Prior Publication Data

US 2014/0235938 A1 Aug. 21, 2014

Related U.S. Application Data

(63) Continuation-in-part of application No. 29/446,261, filed on Feb. 21, 2013, now Pat. No. Des. 694,418, and a continuation-in-part of application No. 29/446,262, filed on Feb. 21, 2013, now Pat. No. Des. 694,419.

(51) Int. Cl.
*A61H 19/00* (2006.01)
*A61H 23/02* (2006.01)

(52) U.S. Cl.
CPC ..... *A61H 23/02* (2013.01); *A61H 19/34* (2013.01); *A61H 19/40* (2013.01); *A61H 2201/0153* (2013.01); *A61H 2201/1692* (2013.01); *A61H 2201/1695* (2013.01); *A61H 2201/5097* (2013.01)

(58) Field of Classification Search
CPC ..... A61H 19/44; A61H 19/32; A61H 19/50; A61H 2201/0153; A61H 2201/5097; A61H 2201/1692; A61H 2201/1695; A61H 23/00; A61H 19/30; A61H 19/34; A61H 19/40; A61F 5/41; A61F 2005/411
USPC ..... 600/38–41; 606/46, 72
See application file for complete search history.

(56) References Cited

U.S. PATENT DOCUMENTS

| | | | | | |
|---|---|---|---|---|---|
| 2,049,434 | A | * | 8/1936 | Erickson | 601/84 |
| D221,267 | S | * | 7/1971 | Herbst | D24/194 |
| D221,643 | S | | 8/1971 | Stewart | |
| 3,978,851 | A | * | 9/1976 | Sobel | 601/95 |
| 5,311,860 | A | | 5/1994 | Doria | |
| D396,292 | S | * | 7/1998 | Nowak | D24/195 |
| 5,876,324 | A | | 3/1999 | Trouchine | |
| 5,925,002 | A | | 7/1999 | Wollman | |

(Continued)

FOREIGN PATENT DOCUMENTS

WO WO 94/07453 4/1994

OTHER PUBLICATIONS

Definition of Palmate from the Free Dictionary, printed Sep. 2, 2016.*

(Continued)

*Primary Examiner* — Samuel G Gilbert
(74) *Attorney, Agent, or Firm* — Conley Rose, P.C.

(57) ABSTRACT

Triple area vibrator designed to stimulate three erogenous zones simultaneously or independently, providing stimulation to the vagina, clitoris, and anal/perianal regions. Also functions as a g spot rocker vibrator designed to stimulate both the g spot and the clitoris. Alternatively, the invention may also be used as a prostate massager. Among the unique aspects of the invention is that the multiple vibrating appendages resemble the shape of a cannabis leaf.

15 Claims, 6 Drawing Sheets

(56) References Cited

U.S. PATENT DOCUMENTS

| | | | | |
|---|---|---|---|---|
| 6,027,444 | A | 2/2000 | Franck | |
| D426,311 | S | 6/2000 | Horowitz | |
| 6,132,366 | A * | 10/2000 | Ritchie et al. | 600/38 |
| 6,468,294 | B2 * | 10/2002 | Griffith | A61J 17/001 601/67 |
| 6,656,139 | B2 * | 12/2003 | Zwezdaryk | 601/46 |
| D584,554 | S | 1/2009 | Brown | |
| 7,662,088 | B2 | 2/2010 | McCaffrey | |
| 7,828,717 | B2 | 11/2010 | Lee | |
| D649,657 | S | 11/2011 | Petersen | |
| 2003/0028134 | A1 | 2/2003 | Lev | |
| 2005/0273024 | A1 | 12/2005 | Nan | |
| 2006/0141903 | A1 * | 6/2006 | Gardos | A61H 19/34 446/490 |
| 2007/0179414 | A1 * | 8/2007 | Imboden et al. | 601/72 |
| 2007/0244418 | A1 | 10/2007 | Harkness | |
| 2010/0087703 | A1 | 4/2010 | Gabrielidis | |
| 2012/0215141 | A1 * | 8/2012 | Peddicord | 601/46 |

OTHER PUBLICATIONS

Definition of actinomorphy, 1 page Jul. 2, 2018.*
Definition of zygomorphic, 1 page Jul. 2, 2018.*
Definition of compound palmate, 1 page, Jul. 2, 2018.*

* cited by examiner

GANJA VIBE

CROSS-REFERENCE TO RELATED APPLICATIONS

This application is a continuation-in-part of application Ser. No. 29/446,261, filed Feb. 21, 2013, and also a continuation-in-part of application Ser. No. 29/446,262, filed Feb. 21, 2013, the disclosures of which are hereby incorporated by reference as if fully set forth herein.

BACKGROUND AND SUMMARY

The present invention relates generally to personal massagers, also known as vibrators. In particular, the invention relates to triple area vibrators, which are designed to stimulate three erogenous zones simultaneously or independently, providing stimulation to the vagina, clitoris, and anal/perianal regions. The invention may also be considered to fall within a category of vibrators referred to as G Spot Rocker style vibrators, which are designed to stimulate both the g spot and the clitoris. Alternatively, the invention may also be used as a prostate massager. Among the unique aspects of the invention is that the multiple vibrating appendages resemble the shape of a cannabis leaf.

The objects and potential uses of the present invention will become readily apparent upon further review of the following description, and various other features and attendant advantages will become more fully appreciated as the invention becomes better understood when considered in conjunction with the accompanying drawings, in which like reference characters designate the same or similar parts throughout the several views.

DETAILED DESCRIPTION

Figure 1:
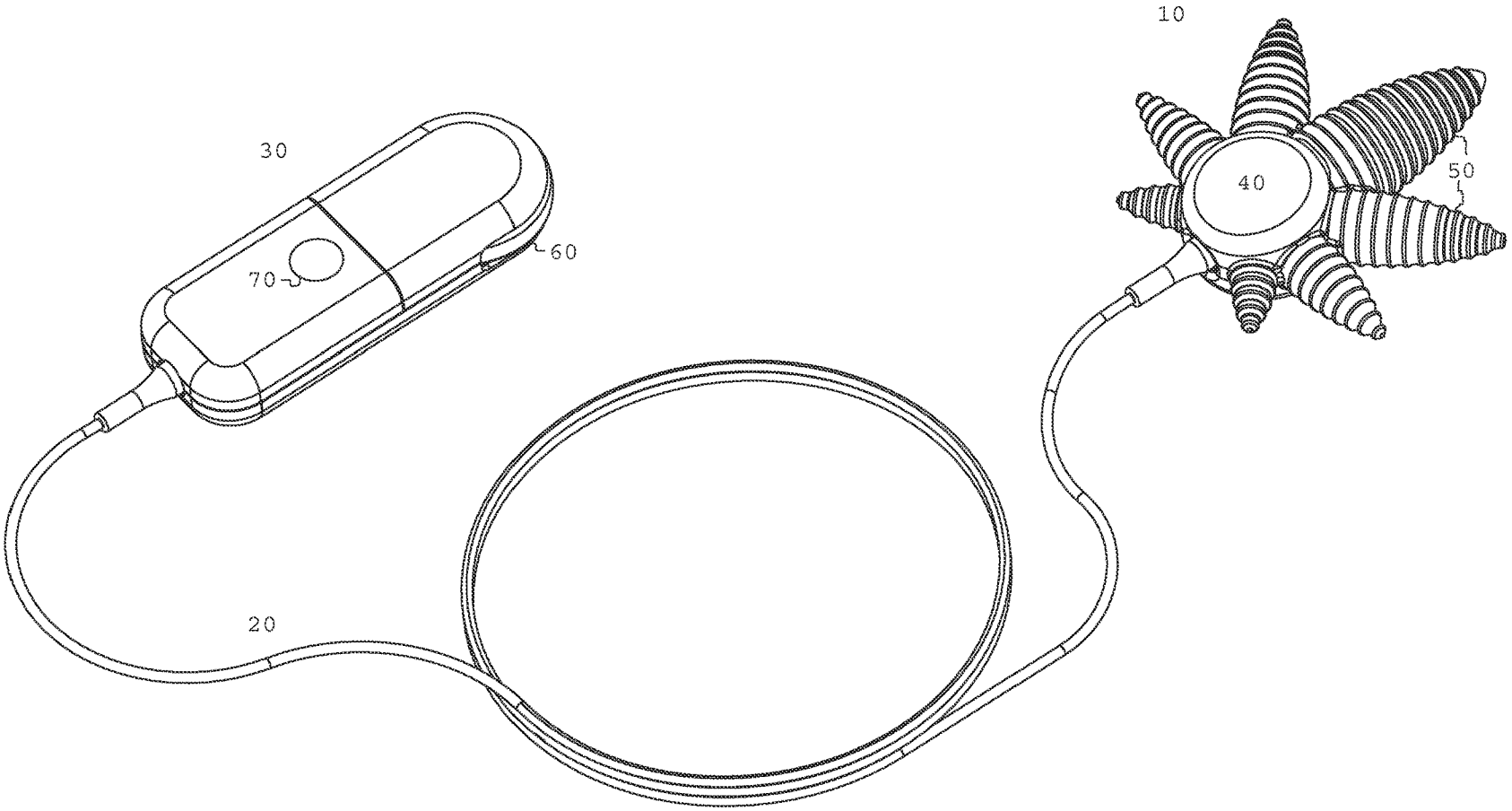
FIG. 1 is a perspective view of an embodiment of the invention including the vibrator and a wired controller.
Figure 2:
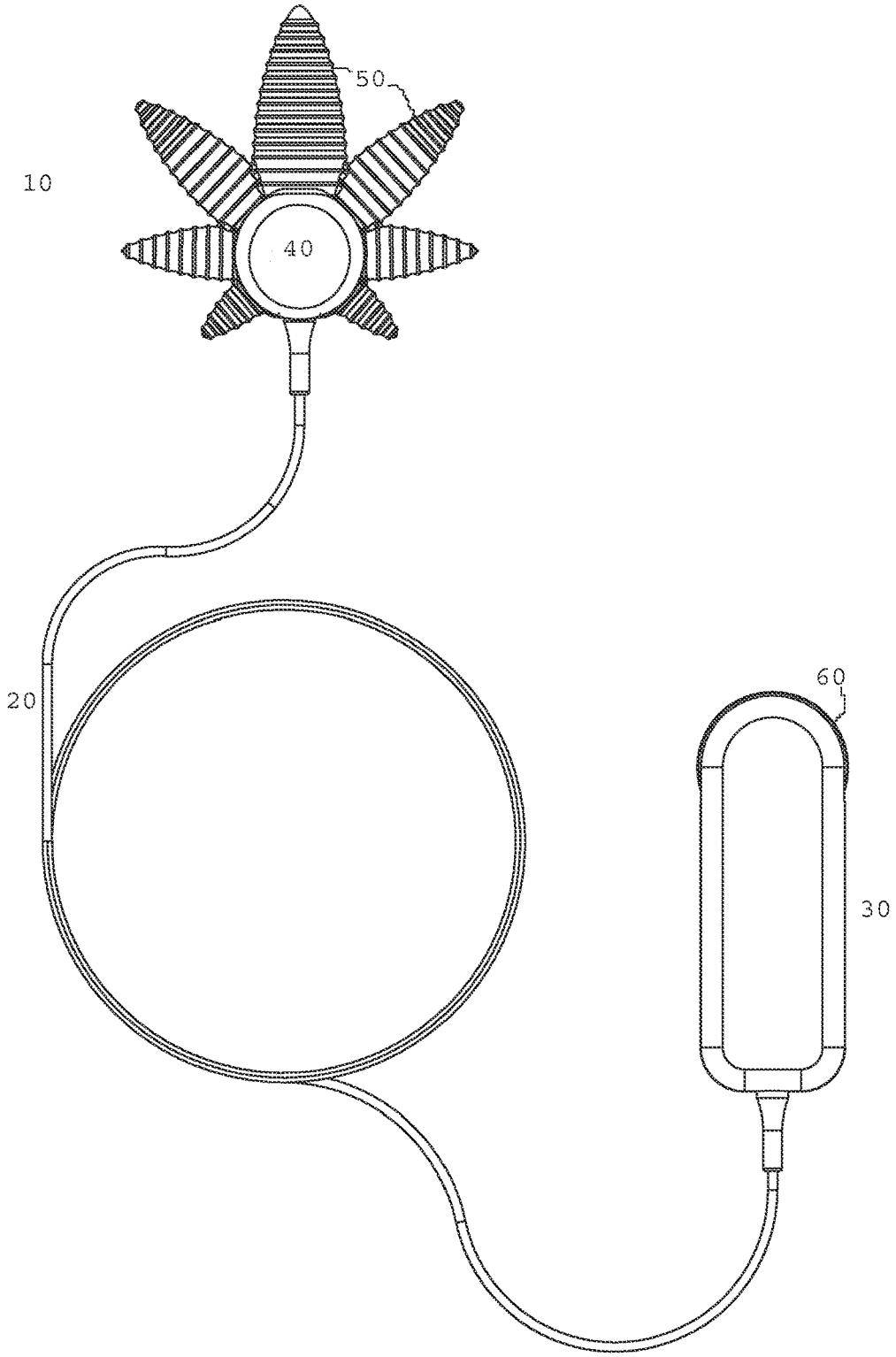
FIG. 2 is a front view of an embodiment of the invention including the vibrator and a wired controller.
Figure 3:
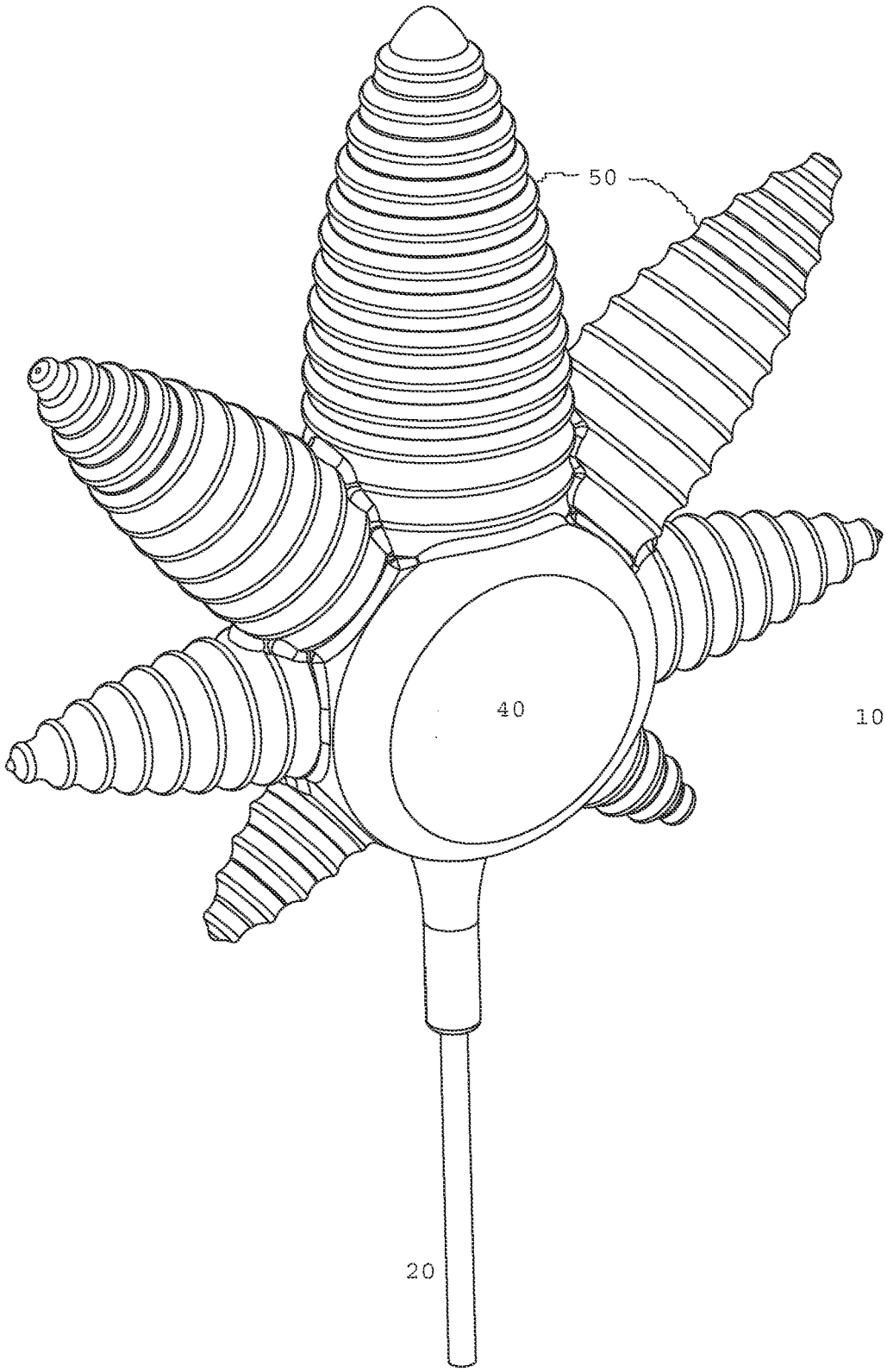
FIG. 3 is a perspective view of an embodiment of the invention including the vibrator.
Figure 6:
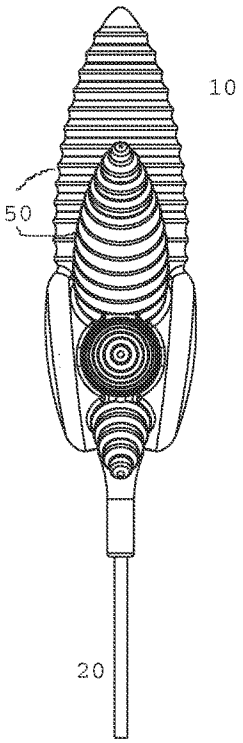
FIG. 6 is a side view of an embodiment of the invention including the vibrator.
Figure 5:
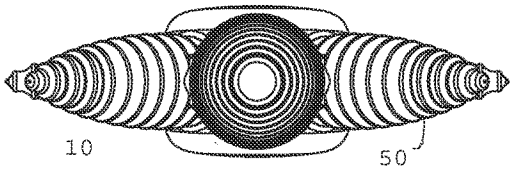
FIG. 5 is a top view of an embodiment of the invention including the vibrator.
Figure 4:
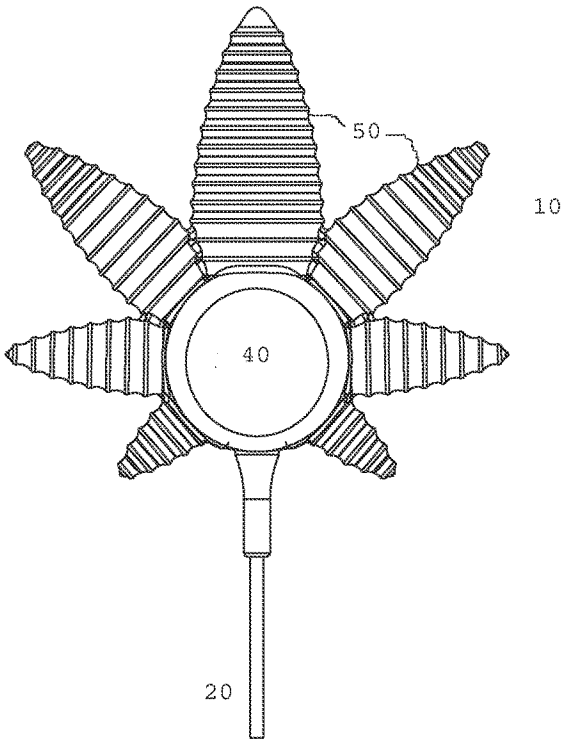
FIG. 4 is a front view of an embodiment of the invention including the vibrator.

FIG. 1 is a perspective view of an embodiment of the invention including the vibrator and a wired controller. Alternatively, the vibrator can be operated using a wireless controller. Vibrator 10 is shown in FIG. 1 as connected to controller 30 by wire 20. FIG. 2 is a front view of an embodiment of the invention, also showing vibrator 10 connected to controller 30 by wire 20. FIG. 3 is a perspective view of an embodiment of the invention including the vibrator. FIGS. 4, 5, and 6 are front, top, and side views of the vibrator. As shown in FIGS. 1-6, appendages 50 emanate from node 40, resembling the leaflets of a compound palmate cannabis leaf. In the embodiment shown in FIGS. 1-6, there are seven appendages, with the largest appendage at the top, and decreasing sizes in an opposite leaflet type arrangement resembling a cannabis leaf. Alternatively, the vibrator could have as few as three appendages, or five, seven, or even more, as nature similarly provides cannabis leaves with variations in the number of leaflets.

A vibrating motor is enclosed in node 40. Alternatively, an off-the-shelf vibrator such as a standard bullet type vibrator could be inserted into node 40 to provide the desired vibration. The vibrations provided by the vibrating motor will vibrate node 40, and radiate through each of the appendages 50 to provide the desired stimulation. The multiple appendages 50 allow the vibrator to function as a triple area vibrator, to stimulate three erogenous zones simultaneously or independently, providing stimulation to the vagina, clitoris, and anal/perianal regions. The vibrator may also function as g spot rocker vibrators, to stimulate both the g spot and the clitoris, simultaneously or independently. Alternatively, the invention may also be used as a prostate massager. The unique design of the vibrator allows for "hands-free use."

The unique shape of the vibrator allows the vibration to remain at the set intensity even while holding the center body of the vibrator, unlike other vibrators of this size in which vibration intensity severely diminishes, or in some cases entirely diminishes, while being held.

The appendages 50 in the embodiments illustrated are shown as ribbed, which provides extra friction to generate additional stimulation. The invention can alternatively be designed with more, less, or no ribs.

Figure 7:
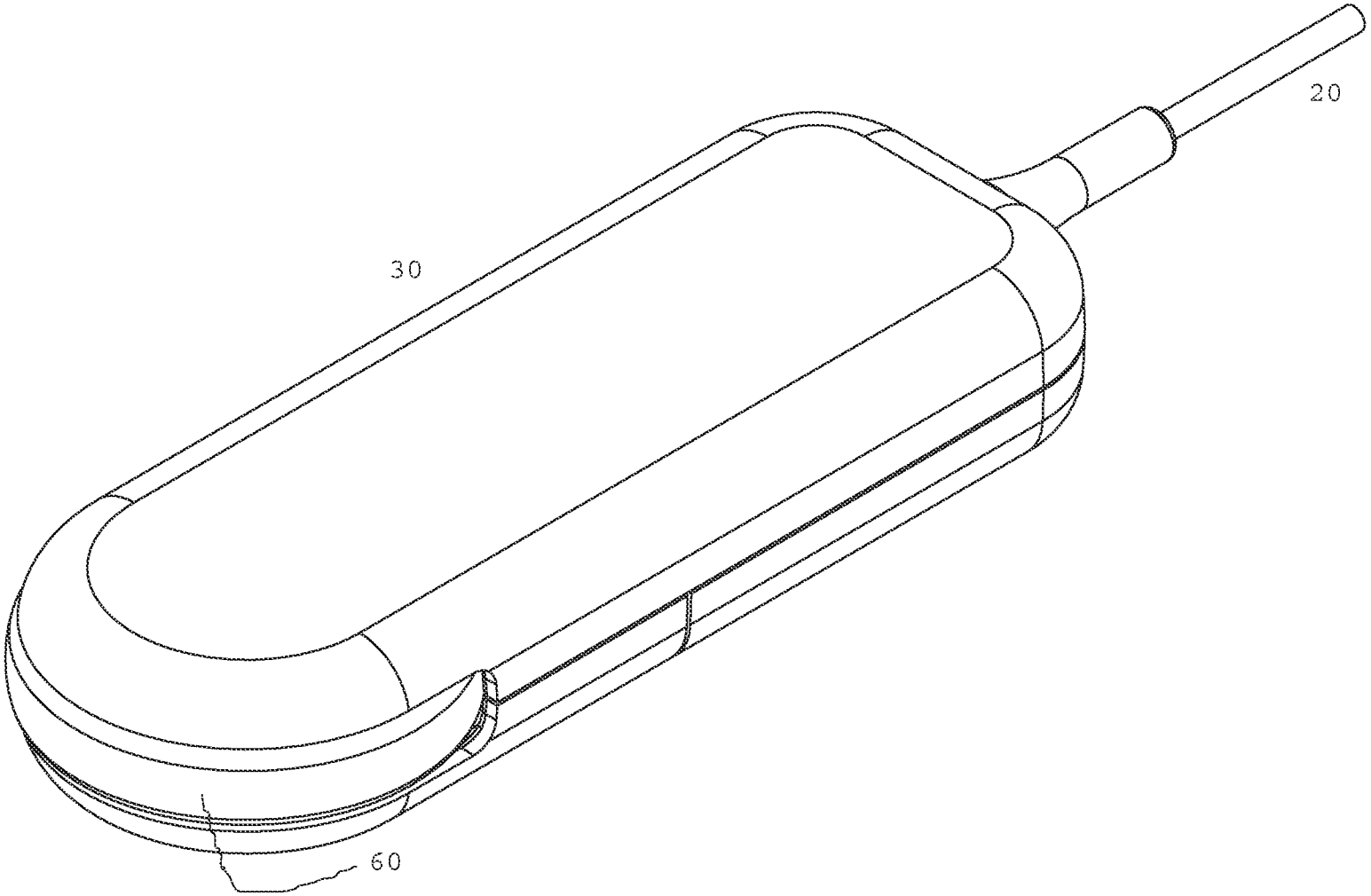
FIG. 7 is a perspective view of an embodiment of the invention including the controller.
Figure 9:
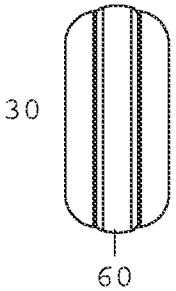
FIG. 9 is a top view of an embodiment of the invention including the controller.
Figure 10:
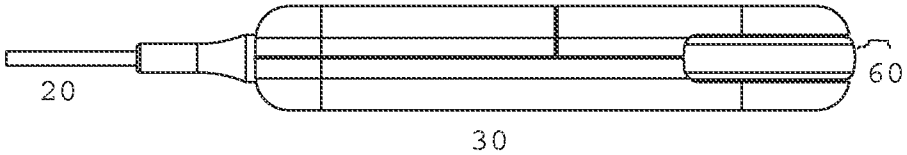
FIG. 10 is a side view of an embodiment of the invention including the controller.
Figure 8:
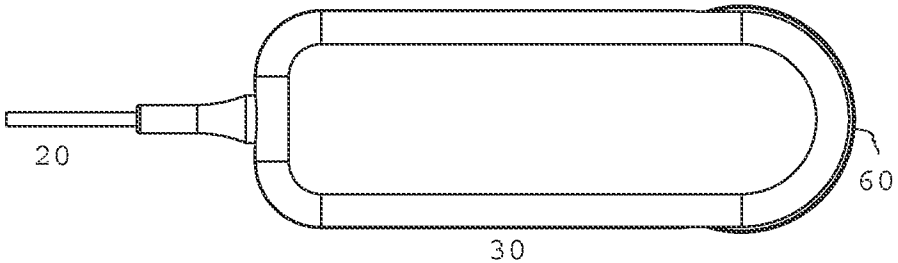
FIG. 8 is a front view of an embodiment of the invention including the controller.

FIG. 7 is a perspective view of an embodiment of the invention including the controller. FIGS. 8-10 are front, top, and side views of controller 30. Controller 30 is shown as a wired controller, which houses one or more batteries to provide power for the vibrator motor, but alternatively the controller can be wireless, with one or more batteries enclosed in node 40 along with the vibrator motor. With reference to FIG. 8, controller 30 includes controller wheel 60, which provides for variable speed control of vibrator 10. Alternatively, controller 60 could be designed with step control, such as with a low, medium, and high setting, or a single speed with only on/off control. FIG. 1 shows an embodiment of the invention having on/off switch 70 in addition to controller wheel 60.

Although various materials can be used to make the vibrator and controller, below is a listing of the preferred and alternative materials that can be used.

Preferred:

Appendages: Medical grade Thermo Plastic Elastomer (15 Durometer)

Node: Polypropylene (PP)

Controller: Polycarbonate/Acrylonitrile Butadiene Styrene blend (PC/ABS)

Controller Wheel: Medical grade Thermo Plastic Elastomer—15 Durometer (TPE)

Alternative:

Appendages: Medical grade Sanoprene (15 Durometer)

Node: High Density Polyethylene (HPDE)

Controller: Straight Polycarbonate (PC) or Straight Acrylonitrile Butadiene Styrene (ABS) no blend Controller Wheel: Medical grade Sanoprene (15 Durometer)

It is to be understood that the present invention is not limited to the embodiments described above, but encompasses any and all embodiments within the scope of the following claims.

I claim:

1. An apparatus comprising:

a triple area vibrator including multiple appendages emanating from a node wherein the appendages comprise:

a first appendage extending from the node along a longitudinal axis; and a first plurality of secondary appendages extending from the node and disposed on a first side of the first appendage; and a second plurality of secondary appendages extending from the node and disposed on a second side of the first appendage that is opposite the first side, wherein the first plurality of secondary appendages have decreasing sizes along the first side of the first appendage, and the second plurality of secondary appendages have decreasing sizes along the second side of the first appendage, and wherein the first plurality of secondary appendages are symmetric to the second plurality of secondary appendages about the longitudinal axis of the first appendage.

2. The apparatus of claim 1, wherein one or more of the appendages include ribs.

3. The apparatus of claim 1, further comprising:

a controller coupled to the vibrator;

the controller configured to house one or more batteries;

wherein the vibrator is configured to be powered by an electric current to energize the vibrator.

4. The apparatus of claim 3, wherein one or more of the appendages include ribs.

5. The apparatus of claim 3, wherein the controller is configured to generate multiple speeds of vibration.

6. The apparatus of claim 5, wherein one or more of the appendages include ribs.

7. The apparatus of claim 1, wherein the multiple appendages comprises 5 appendages.

8. The apparatus of claim 1, wherein the multiple appendages comprise at least 7 appendages.

9. The apparatus of claim 1, further comprising:

a wireless controller configured to communicate wirelessly with the vibrator;

wherein the vibrator is configured to house one or more batteries; and wherein the vibrator is configured to be powered by an electric current and is configured to be controlled wirelessly by the controller.

10. The apparatus of claim 9, wherein one or more of the appendages include ribs.

11. The apparatus of claim 9 wherein the wireless controller is configured to generate multiple speeds of vibration.

12. The apparatus of claim 11, wherein one or more of the appendages include ribs.

13. The apparatus of claim 1, wherein the vibrator is configured to function as a prostate massager.

14. The apparatus of claim 1, further comprising a motor disposed within the node, wherein the motor is configured to actuate vibration of each of the appendages.

15. The apparatus of claim 1, wherein the appendages are arranged in a pattern that is shaped as leaflets of a compound palmate *cannabis* leaf.

* * * * *